US008570133B2

(12) United States Patent
Matsuda et al.

(10) Patent No.: US 8,570,133 B2
(45) Date of Patent: Oct. 29, 2013

(54) TRANSFORMER

(75) Inventors: Yasuhiro Matsuda, Osaka (JP); Hideki Tamura, Shiga (JP); Takuya Kagawa, Kyoto (JP); Tomohiro Ota, Hyogo (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/581,502

(22) PCT Filed: Mar. 25, 2010

(86) PCT No.: PCT/JP2010/055241
§ 371 (c)(1),
(2), (4) Date: Aug. 28, 2012

(87) PCT Pub. No.: WO2011/118004
PCT Pub. Date: Sep. 29, 2011

(65) Prior Publication Data
US 2012/0326829 A1 Dec. 27, 2012

(51) Int. Cl.
*H01F 17/06* (2006.01)

(52) U.S. Cl.
USPC ..... 336/178

(58) Field of Classification Search
USPC ..... 336/65, 83, 200, 232, 178
See application file for complete search history.

(56) References Cited

U.S. PATENT DOCUMENTS

| | | | | |
|---|---|---|---|---|
| 7,176,775 | B2 * | 2/2007 | Ohta | 336/200 |
| 7,375,607 | B2 * | 5/2008 | Lee et al. | 336/178 |
| 2006/0227482 | A1 | 10/2006 | Ohta | |

FOREIGN PATENT DOCUMENTS

| | | | | |
|---|---|---|---|---|
| DE | 3900286 | A1 | * | 8/1989 |
| JP | 03208314 | A | * | 9/1991 |
| JP | 10-022131 | A | | 1/1998 |
| JP | 11-054345 | A | | 2/1999 |
| JP | 11-345721 | A | | 12/1999 |
| JP | 2003-017334 | A | | 1/2003 |
| JP | 2003143851 | A | * | 5/2003 |
| JP | 2005-150414 | A | | 6/2005 |
| JP | 2006-294728 | A | | 10/2006 |
| JP | 2008-210998 | A | | 9/2008 |
| JP | 2009-170804 | A | | 7/2009 |

OTHER PUBLICATIONS

International Search Report for corresponding International Application No. PCT/JP2010/055241 mailed Jun. 29, 2010.
Form PCT/ISA/237 for corresponding International Application No. PCT/JP2010/055241 dated Jun. 29, 2010.

* cited by examiner

*Primary Examiner* — Tuyen Nguyen
(74) *Attorney, Agent, or Firm* — Renner, Otto, Boisselle & Sklar, LLP

(57) ABSTRACT

A transformer includes: a core assembly 1 composed of a pair of E-shaped cores 11, 12 each having two side leg portions 1*a*, 1*b* and a central leg portion 1*c* therebetween, end surfaces of the central leg portions 1*c* and end surfaces of the side leg portions 1*a*, 1*b* of the E-shaped cores 11, 12 oppose each other, respectively, and a gap G is provided between at least the end surfaces of the central leg portions 1*c*; a primary coil N1 formed by winding round wire around a perimeter of the central leg portion 1*c*; and a secondary coil N2 formed by winding rectangular wire around a perimeter of the central leg portion 1*c* by edgewise winding, wherein a space for reducing leakage flux from the gap G that acts on the secondary coil N2 is provided between the secondary coil N2 and the gap G.

14 Claims, 11 Drawing Sheets

TRANSFORMER

TECHNICAL FIELD

The present invention relates in general to a transformer.

BACKGROUND ART

There used to be known a conventional low height transformer, as shown in FIG. 16. In the conventional low height transformer, a core assembly 1 is formed by combining a pair of E-shaped cores 11, 12, and a primary coil N1 and a secondary coil N2 are wound within the core assembly 1. In the core assembly 1, end surfaces of side leg portions 1*a*, 1*b* of the respective E-shaped cores 11, 12 are opposed and are in contact with each other, respectively, while a gap G for inductance adjustment is provided between end surfaces of mutually opposing central leg portions 1*c*. The primary coil N1 and the secondary coil N2 are wound around a perimeter of the central leg portion 1*c*, using spaces between the central leg portion 1*c* and the side leg portions 1*a*, 1*b* as coil housing spaces.

In this type of low height transformer, due to limitations on coil winding space, the secondary coil N2, which has a small number of windings and outputs a low voltage and a large current, is formed of a strip-shaped rectangular wire wound by edgewise winding as shown in FIG. 17 (for example, refer to Japanese Patent Application Publication No. H10-22131).

In the conventional transformer, the primary coil N1 is wound in a region opposing a side face of the central leg portion 1*c* of the E-shaped core 11 (or 12) and the secondary coil N2 is wound in a region opposing the gap G. Therefore, the secondary coil N2 is wound such that an inner peripheral surface thereof contacts with the gap G. As a result, leakage flux from the gap G is to cross the secondary coil N2 composed of the rectangular wire, and causing an increase in eddy current loss.

DISCLOSURE OF THE INVENTION

The present invention has been designed in consideration of the circumstances described above, and an object thereof is to provide a transformer with which eddy current loss caused by leakage flux from a gap can be reduced while using rectangular wire for a secondary coil.

A transformer according to the present invention includes: a core assembly, which is composed of a pair of E-shaped cores each having two side leg portions and a central leg portion between the two side leg portions, and in which end surfaces of the central leg portions and end surfaces of the side leg portions of the E-shaped cores oppose each other, respectively, said core assembly being provided with a gap which is defined between the end surfaces of the central leg portions; a primary coil formed by winding a round wire around a perimeter of the central leg portion; and a secondary coil formed by winding a rectangular wire around a perimeter of the central leg portion by edgewise winding, wherein a space for reducing leakage flux from the gap that acts on the secondary coil is provided between the secondary coil and the gap.

According to this invention, the secondary coil is distanced from the gap, and the space for reducing leakage flux from the gap acting on the secondary coil is formed between the secondary coil and the gap. Hence, the amount of leakage flux from the gap that crosses the rectangular wire of the secondary coil can be reduced in comparison with a conventional transformer, and as a result, eddy current loss can be reduced.

In other words, eddy current loss caused by leakage flux from the gap can be reduced while using rectangular wire for the secondary coil.

In an embodiment, the secondary coil is wound only in a region opposing a side face of the central leg portion of either one of the E-shaped cores.

According to this embodiment, the secondary coil is distanced from the gap, and the space for reducing leakage flux from the gap that acts on the secondary coil is formed between the secondary coil and the gap. Therefore, eddy current loss caused by leakage flux from the gap can be reduced while using rectangular wire for the secondary coil.

In an embodiment, the secondary coil is wound in a region opposing the gap, and a space is formed between the gap and an inner peripheral surface of the secondary coil.

According to this embodiment, the secondary coil is distanced from the gap, and the space for reducing leakage flux from the gap that acts on the secondary coil is formed between the secondary coil and the gap. Therefore, eddy current loss caused by leakage flux from the gap can be reduced while using rectangular wire for the secondary coil.

In an embodiment, the primary coil is wound in a region opposing the gap, and the secondary coil is wound so as to be divided in two regions opposing side faces of the respective central leg portions of the pair of E-shaped cores.

According to this embodiment, even when the secondary coil has an increased number of windings, the secondary coil is distanced from the gap and the space for reducing leakage flux from the gap that acts on the secondary coil is formed between the secondary coil and the gap. Therefore, eddy current loss caused by leakage flux from the gap can be reduced while using rectangular wire for the secondary coil.

In an embodiment, the primary coil is wound in a region opposing the gap, the secondary coil is wound so as to be divided in two regions which oppose side faces of the respective central leg portions of the pair of E-shaped cores and which are equidistant from the primary coil, and a connection point of the secondary coil which is divided and wound in the respective regions is used as a center tap.

According to this embodiment, variation in leakage inductance can be reduced in the case of a center tap type transformer.

In an embodiment, the transformer includes a spacer which contacts with at least one of the primary coil and the secondary coil so as to perform positioning of the primary coil and the secondary coil is provided.

According to this embodiment, the primary coil and the secondary coil can be positioned easily, and therefore the secondary coil can be distanced from the gap easily.

BRIEF DESCRIPTION OF THE DRAWINGS

Preferred embodiments of the present invention will be described in further detail below. Other features and advantages of the present invention may be understood better in relation to the following detailed description and the attached drawings, wherein.

BEST MODE FOR CARRYING OUT THE INVENTION (First Embodiment)

Figure 1:
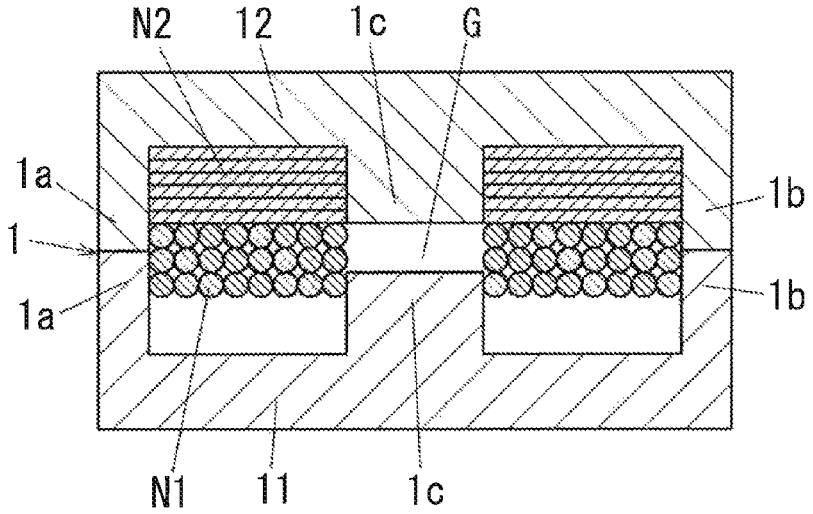
FIG. 1 is a lateral sectional view showing a transformer according to a first embodiment.
Figure 2:
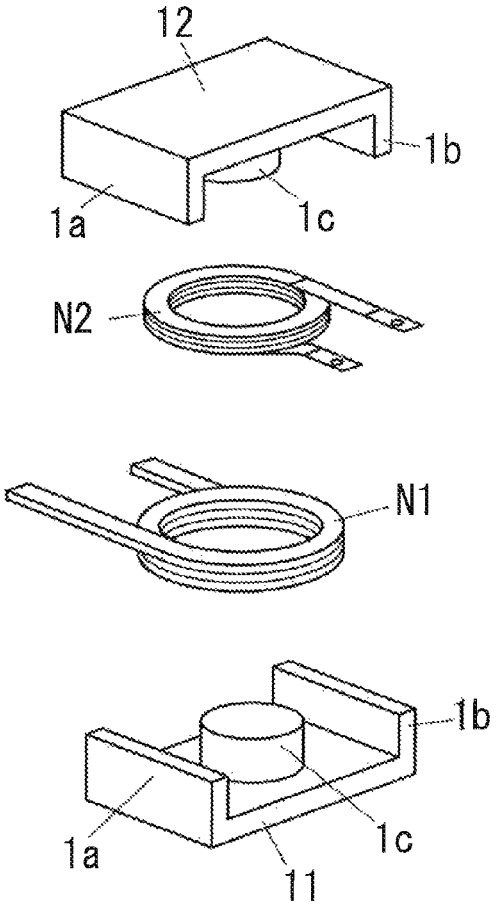
FIG. 2 is an exploded perspective view of the transformer according to the first embodiment.

As shown in FIGS. 1 and 2, a transformer according to this embodiment is constituted by a low height transformer, in which a core assembly 1 is formed by combining a pair of E-shaped cores 11, 12, and a primary coil N1 and a secondary coil N2 are wound within the core assembly 1. In the core assembly 1, E-shaped cores 11, 12 are arranged so that respective end surfaces of rectangular parallelepiped-shaped side leg portions 1*a*, 1*b* are opposed and in contact with each other. In addition, the core assembly 1 is provided with a gap G for inductance adjustment between end surfaces of mutually opposing column-shaped central leg portions 1*c*. The primary coil N1 and the secondary coil N2 are wound in an annular shape around a perimeter of the central leg portion 1*c*, using a space between the central leg portion 1*c* and the side leg portions 1*a*, 1*b* as a coil housing space.

The primary coil N1 has a large number of windings, and is input a high voltage and a small current. Round wire is used for the primary coil N1, and the primary coil N1 is wound in a region opposing the gap G. Here, an allowable current required for the primary coil N1 is comparatively small, and therefore eddy current loss can be reduced by employing Litz wire having a small wire diameter as the round wire.

The secondary coil N2 has a small number of windings, and outputs a low voltage and a large current. Strip-shaped rectangular wire is used for the secondary coil N2, and the secondary coil N2 is wound in a region opposing a side face of the central leg portion 1*c* of the E-shaped core 11 (or 12) by edgewise winding. Herein, the secondary coil N2 is not wound on the gap G side than the end surface of the central leg portion 1*c* of the E-shaped core 11 (or 12), and the secondary coil N2 therefore does not oppose the gap G.

By disposing the secondary coil N2 as described above, the secondary coil N2 is distanced from the gap G, and therefore a "space for reducing leakage flux from the gap G that acts on the secondary coil N2" (in FIG. 1, a space lateral to the gap G in which the primary coil N1 is disposed) is formed between the secondary coil N2 and the gap G. Hence, this configuration can reduce an amount of leakage flux from the gap G that crosses the secondary coil N2 of the rectangular wire in comparison with a conventional transformer, and as a result, eddy current loss can be reduced.

Further, a width of the rectangular wire constituting the secondary coil N2 is formed to be substantially identical to a dimension of interval between the side leg portion 1*a*, 1*b* and the central leg portion 1*c* of the E-shaped core. Therefore, it can secure a comparatively large allowable current.

Figure 3:
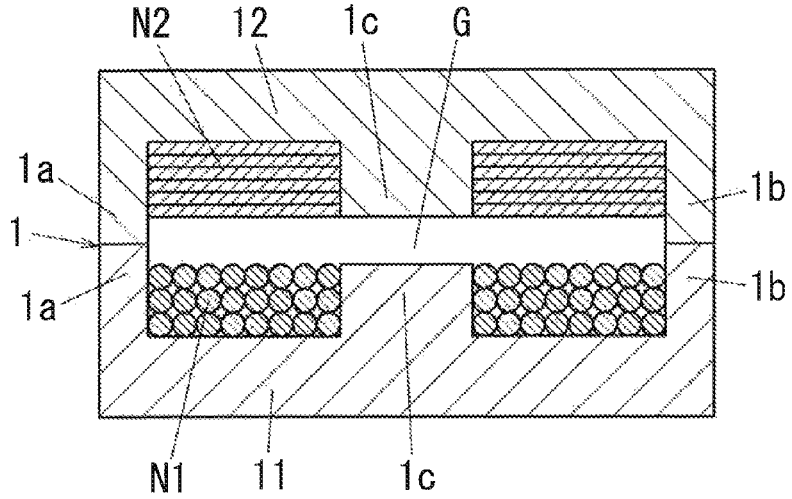
FIG. 3 is a lateral sectional view showing another transformer according to the first embodiment.

Note that, as shown in FIG. 3, the primary coil N1 may be wound in a region opposing the side face of the central leg portion 1*c* of the E-shaped core 12 (or 11) where the secondary coil N2 is not provided. In this case, the space for reducing leakage flux from the gap G that acts on the secondary coil N2 corresponds to a space lateral to the gap G in FIG. 3.

(Second Embodiment)

Figure 4:
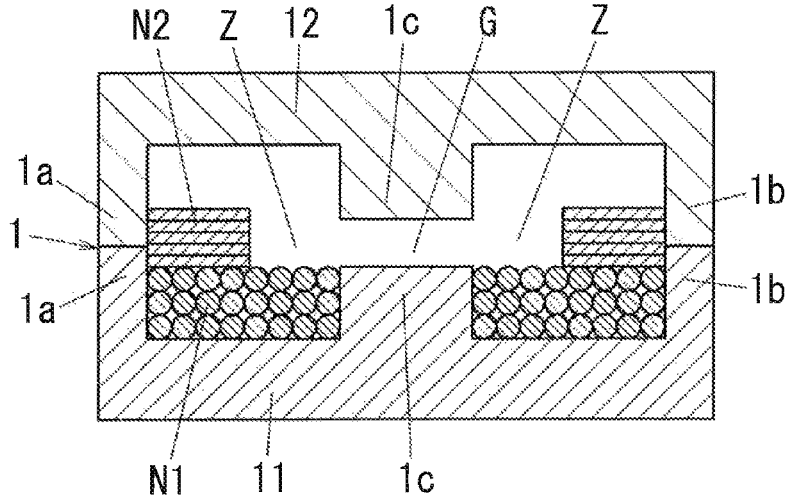
FIG. 4 is a lateral sectional view showing a transformer according to a second embodiment.

As shown in FIG. 4, in a transformer according to this embodiment, the primary coil N1 is wound in the region opposing the side face of the central leg portion 1*c* of the E-shaped core 11 (or 12), and the secondary coil N2 is wound in the region opposing the gap G. Note that, identical configurations to the first embodiment have been allocated identical reference symbols, and description thereof has been omitted.

The width of the rectangular wire constituting the secondary coil N2 is smaller than the dimension of the interval between the side leg portion 1*a*, 1*b* and the central leg portion 1*c* of the E-shaped core. A space Z is therefore formed between an inner peripheral surface of the secondary coil N2 and the gap G. In other words, the secondary coil N2 is distanced from the gap G, and a space for reducing leakage flux from the gap G that acts on the secondary coil N2 is formed between the secondary coil N2 and the gap G. Hence, the amount of leakage flux from the gap G that crosses the secondary coil N2 of the rectangular wire can be reduced in comparison with a conventional transformer, and as a result, eddy current loss can be reduced.

Figure 5:
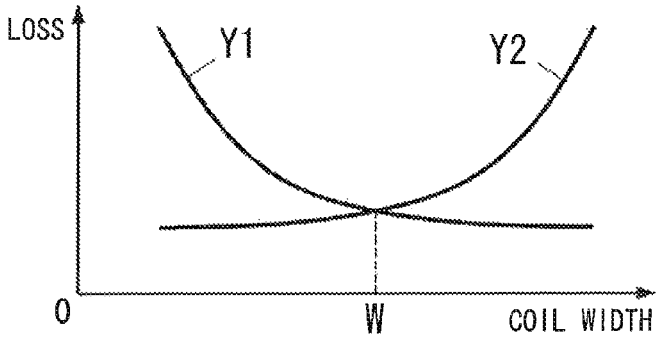
FIG. 5 is a view showing a relationship between a coil width and loss according to the second embodiment.

Further, as shown in FIG. 5, the width of the rectangular wire constituting the secondary coil N2 is determined at a dimension W at which a sum of conduction loss Y1 in the form of copper loss generated by a coil current and eddy current loss Y2 caused by the leakage flux from the gap G is minimized. In other words, the rectangular wire has an optimum width based on the conduction loss and the eddy current loss.

Figure 6:
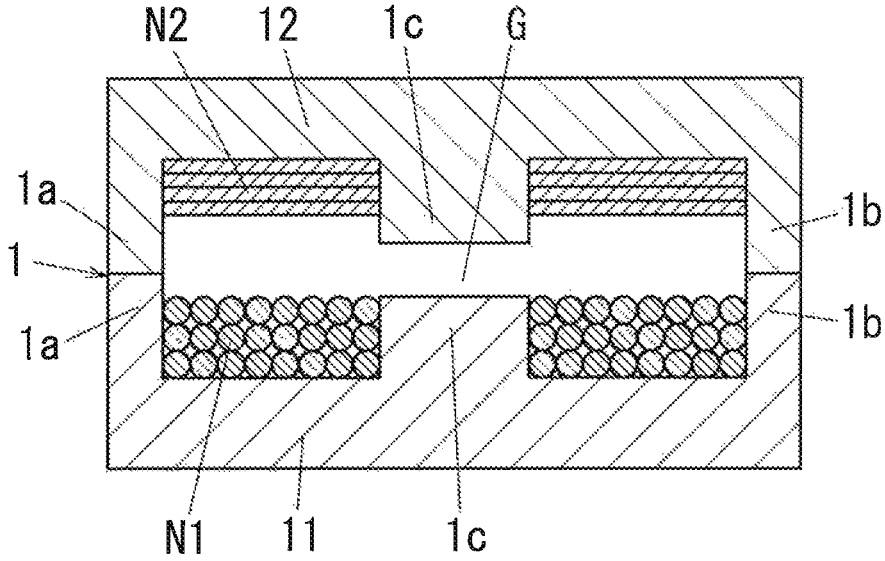
FIG. 6 is a lateral sectional view showing another transformer according to the second embodiment.
Figure 7:
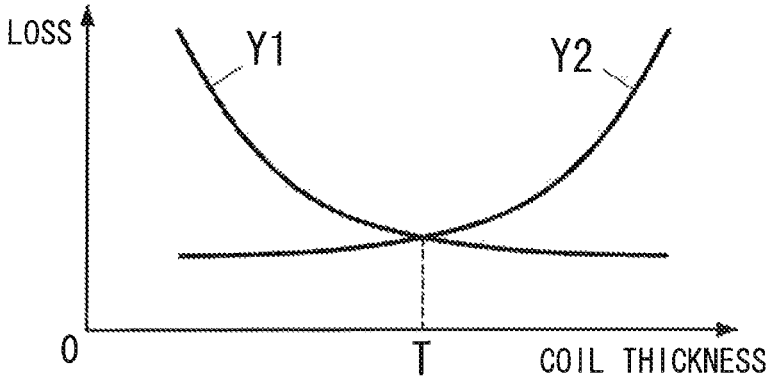
FIG. 7 is a view showing a relationship between a coil thickness and loss according to the second embodiment.

Furthermore, as shown in FIG. 6, the secondary coil N2 can be distanced from the gap G by reducing a thickness of the rectangular wire constituting the coil N2. In this configuration, similar effects to those described above can be obtained. As shown in FIG. 7, the thickness of the rectangular wire constituting the secondary coil N2 is determined at a dimension T at which the sum of the conduction loss Y1 in the form of copper loss generated by the coil current and the eddy current loss Y2 caused by the leakage flux from the gap G is minimized. In other words, the rectangular wire has an optimum thickness based on the conduction loss and the eddy current loss.

In other words, the secondary coil N2 is distanced from the gap G by reducing a volume of the secondary coil N2, and the volume of the secondary coil N2 is set such that the sum of the conduction loss and the eddy current loss is minimized.

(Third Embodiment)

Figure 8:
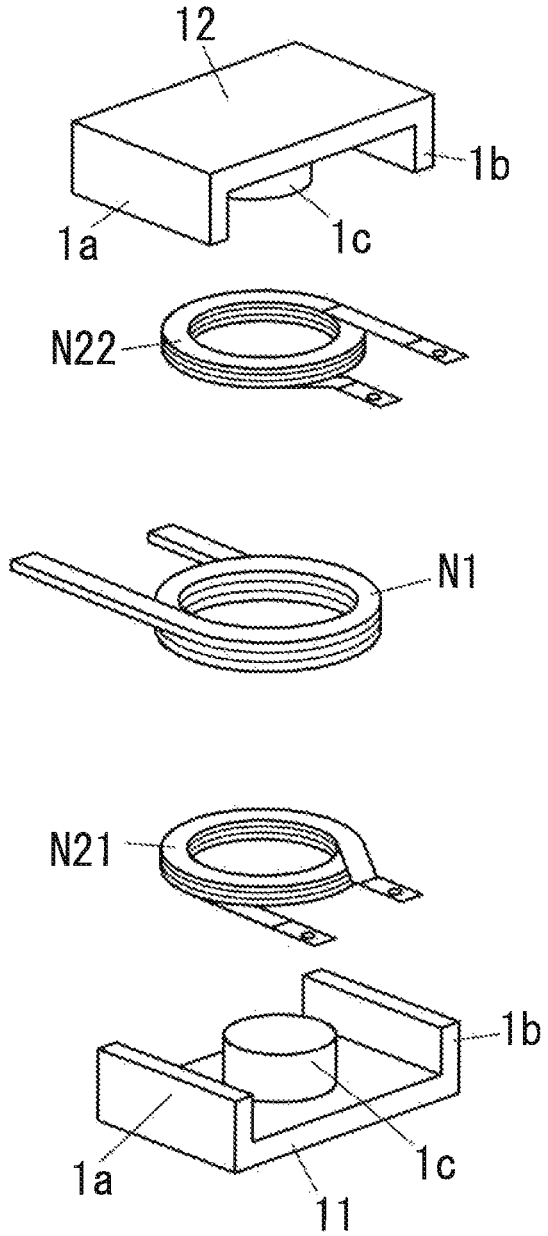
FIG. 8 is an exploded perspective view showing a transformer according to a third embodiment.
Figure 9:
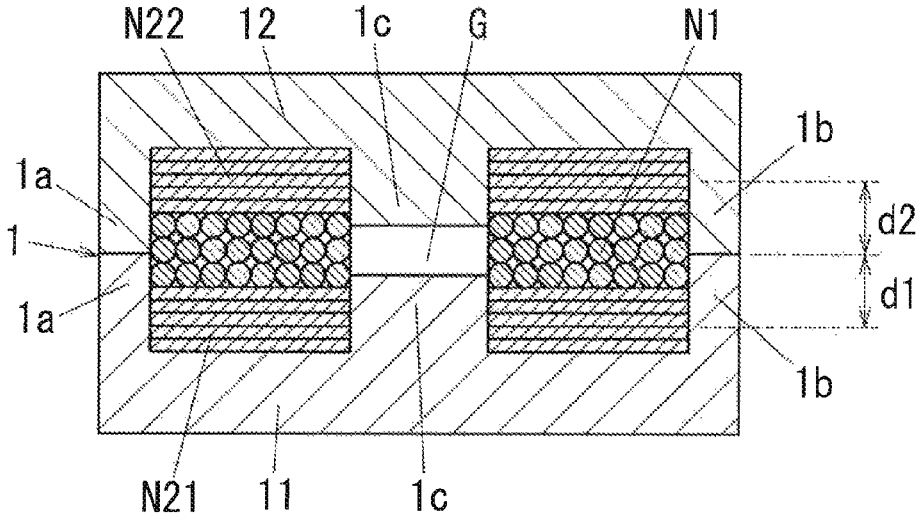
FIG. 9 is a lateral sectional view of the transformer according to the third embodiment.

A transformer according to this embodiment corresponds to a secondary coil N2 having a large number of windings. As shown in FIGS. 8 and 9, the primary coil N1 is wound in the region opposing the gap G. The secondary coil N2 is divided into two secondary coils N21, N22 having an equal number of windings. The secondary coils N21, N22 are wound respectively in two regions opposing the side faces of the respective central leg portions 1*c* of the E-shaped cores 11 and 12. In other words, the secondary coils N21, N22 are disposed so that the primary coil N1 is sandwiched therebetween, and the secondary coil N2 is formed by connecting respective single ends of the secondary coils N21, N22 to each other so that the secondary coils N21, N22 are connected in series. Note that, identical configurations to the first embodiment have been allocated identical reference symbols, and description thereof has been omitted.

The secondary coils N21, N22 are not wound on the gap G side than the end surfaces of the central leg portions 1*c* of the E-shaped cores 11, 12. Each of the secondary coils N21, N22 therefore does not opposes the gap G. Hence, the secondary coils N21, N22 are distanced from the gap G, and a space for reducing leakage flux from the gap G that acts on the secondary coils N21, N22 (in FIG. 9, a space lateral to the gap G in which the primary coil N1 is disposed) is formed between the gap G and the secondary coils N21, N22. Therefore, even when the secondary coil N2 has an increased number of windings, the amount of leakage flux from the gap G that crosses the secondary coil N2 of the rectangular wire can be reduced in comparison with a conventional transformer, and as a result, eddy current loss can be reduced.

Figure 10:
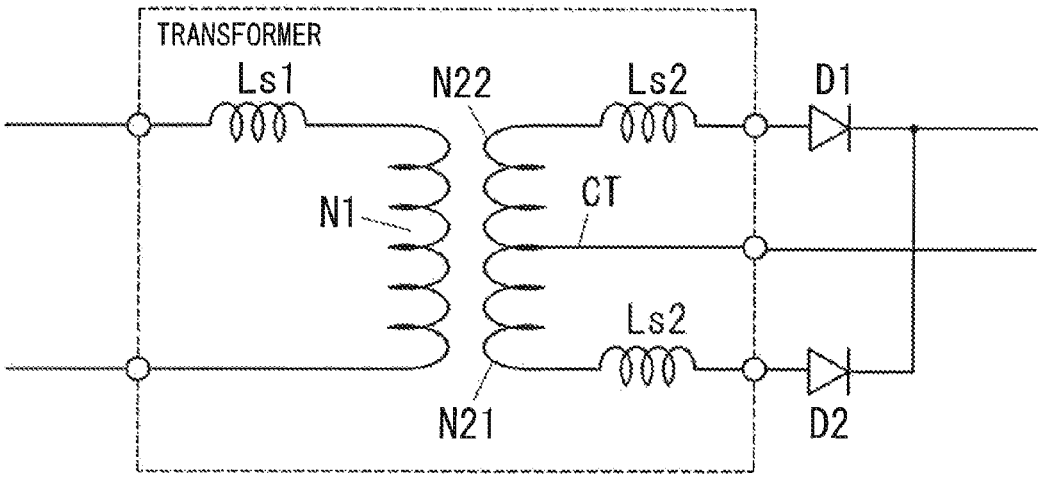
FIG. 10 is a schematic circuit diagram showing a center tap type transformer according to the third embodiment.

Further, as shown in FIG. 10, a connection point of the secondary coils N21, N22 may be drawn out to the exterior of the transformer as a center tap CT, whereupon diodes D1, D2 may be connected in series to respective outputs of the secondary coils N21, N22 in order to perform full wave rectification. In this case, the primary coil N1 and the secondary coils N21, N22 may be disposed such that a distance d1 in a winding axis direction between the primary coil N1 and the secondary coil N21 is identical to a distance d2 in the winding axis direction between the primary coil N1 and the secondary coil N22 (see FIG. 9). This configuration can reduce variation in leakage inductance Ls1 equivalently connected in series to the primary coil N1 and leakage inductances Ls2 equivalently connected in series to the secondary coils N21, N22.

(Fourth Embodiment)

Figure 11:
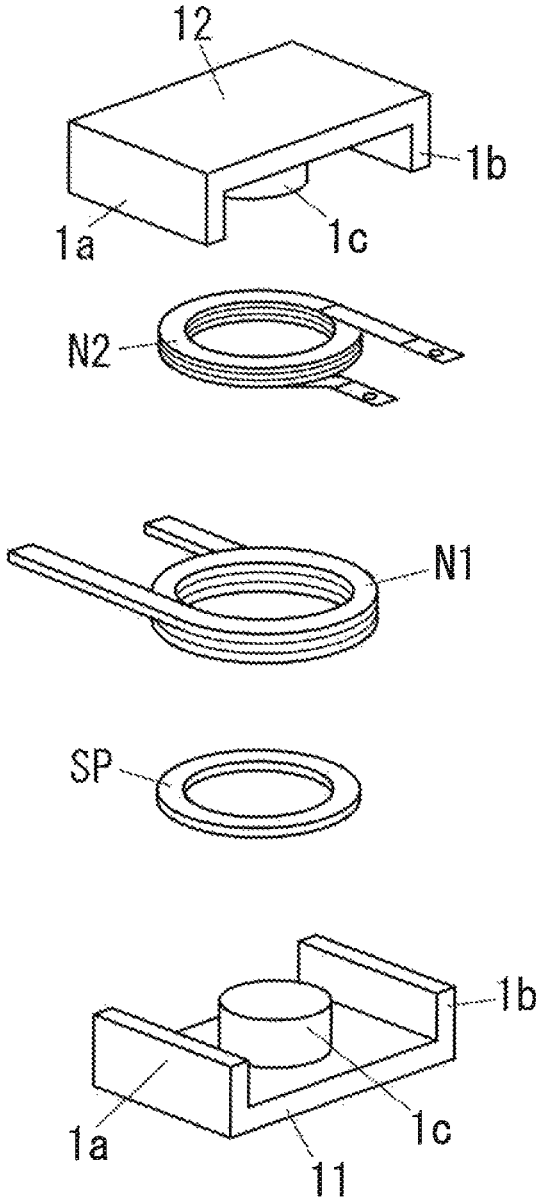
FIG. 11 is an exploded perspective view showing a transformer according to a fourth embodiment.
Figure 12:
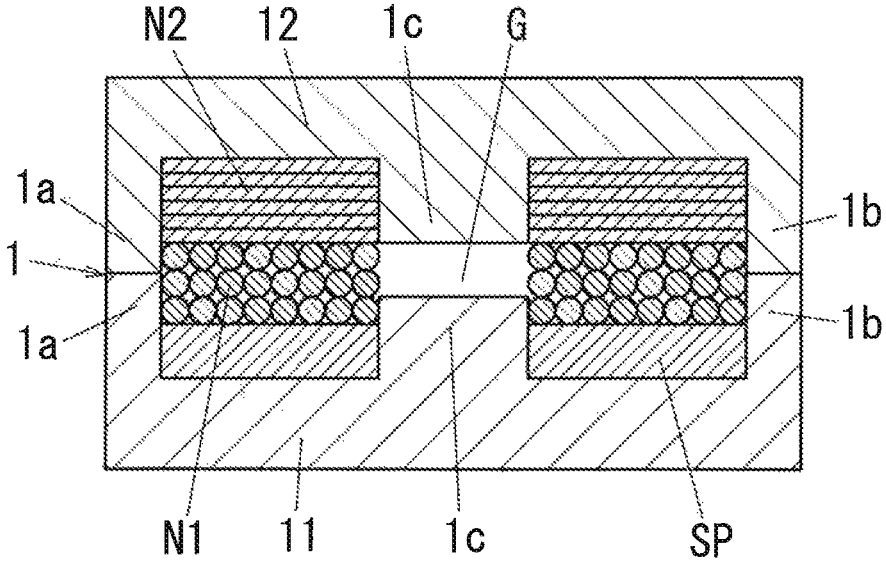
FIG. 12 is an exploded perspective view of the transformer according to the fourth embodiment.

As shown in FIGS. 11 and 12, in a transformer according to this embodiment, the primary coil N1 is wound in the region opposing the gap G, the secondary coil N2 is wound in the region opposing the side face of the central leg portion 1*c* of the E-shaped core 12, and a ring-shaped spacer SP into which the central leg portion 1*c* of the E-shaped core 11 is inserted is disposed in an interspace between the primary coil N1 and an inner surface of the E-shaped core 11. One surface of the spacer SP contacts with the E-shaped core 11, and the other surface thereof contacts with the primary coil N1. By stacking the spacer SP, the primary coil N1, and the secondary coil N2 in the coil housing space within the core assembly 1, the primary coil N1 and the secondary coil N2 can be positioned easily.

Figure 13:
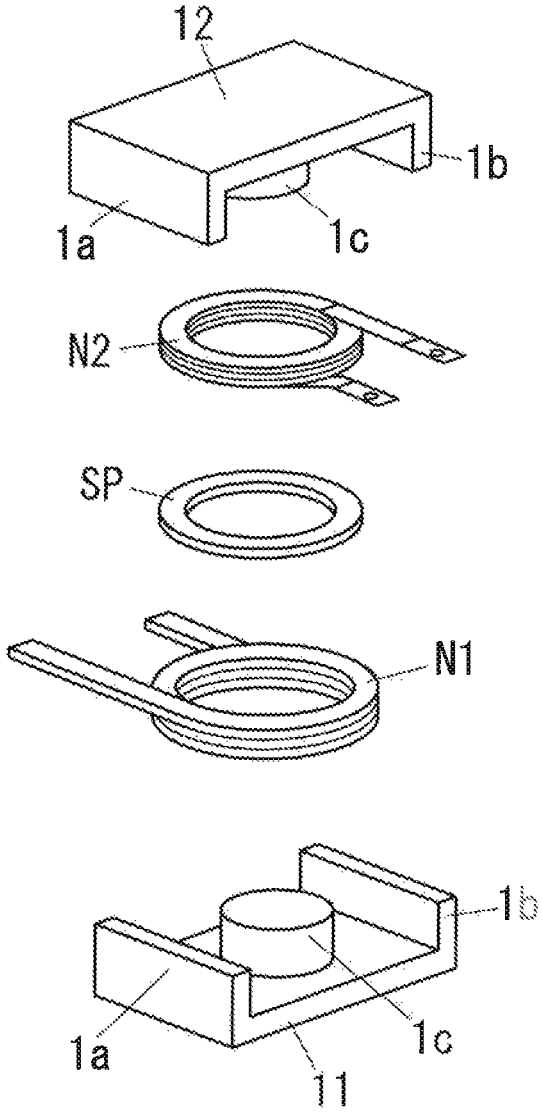
FIG. 13 is an exploded perspective view showing another transformer according to the fourth embodiment.
Figure 14:
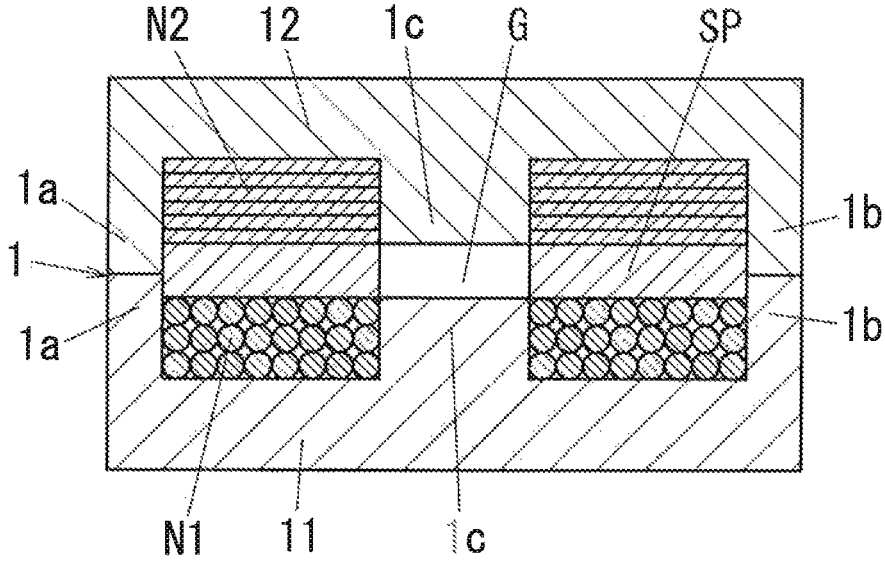
FIG. 14 is an exploded perspective view showing the another transformer according to the fourth embodiment.

Further, as shown in FIGS. 13 and 14, when the primary coil N1 is wound in the region opposing the side face of the central leg portion 1*c* of the E-shaped core 11 and the secondary coil N2 is wound in the region opposing the side face of the central leg portion 1*c* of the E-shaped core 12, the ring-shaped spacer SP is disposed in an interspace (the region opposing the gap G) between the primary coil N1 and the secondary coil N2. One surface of the spacer SP contacts with the primary coil N1, and the other surface thereof contacts with the secondary coil N2.

Figure 15:
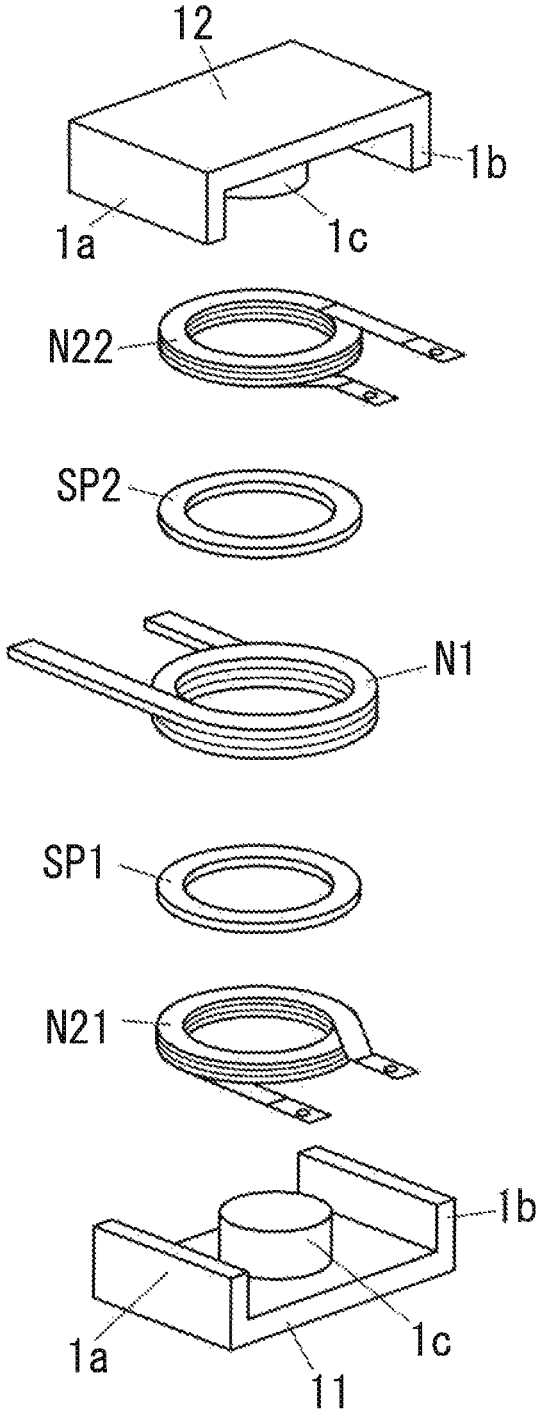
FIG. 15 is an exploded perspective view showing a further transformer according to the fourth embodiment.
Figure 16:
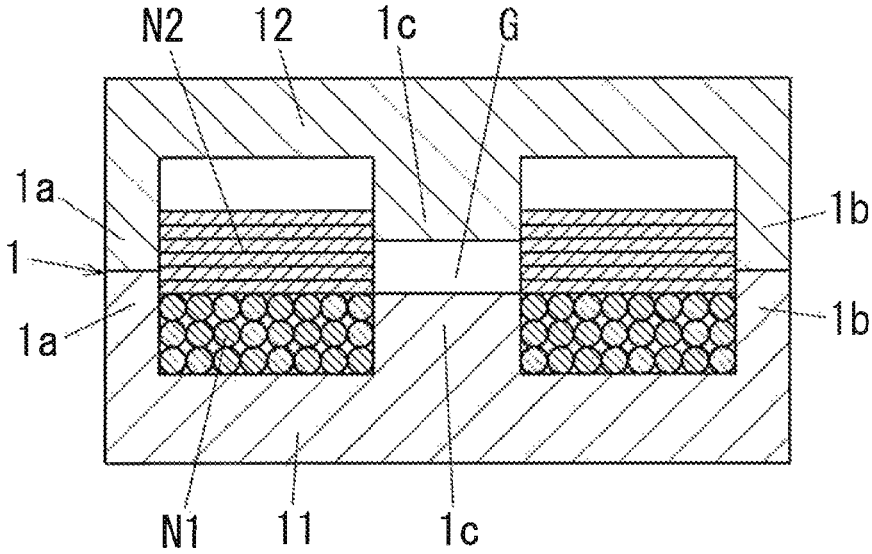
FIG. 16 Conventional Art
FIG. 16 is a lateral sectional view showing a conventional transformer.
Figure 17:
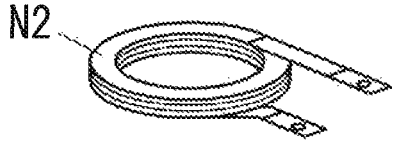
FIG. 17 Conventional Art
FIG. 17 is a perspective view showing a secondary coil.

Furthermore, as shown in FIG. 15, the secondary coil N2 may be divided into the two secondary coils N21, N22, as in the third embodiment. In this case, the primary coil N1 is wound in the region opposing the gap G, the secondary coils N21, N22 are wound respectively in the two regions opposing the side faces of the respective central leg portions 1*c* of the E-shaped cores 11 and 12, a ring-shaped spacer SP1 into which the central leg portion 1*c* of the E-shaped core 11 is inserted is disposed in an interspace between the primary coil N1 and the secondary coil N21, and a ring-shaped spacer SP2 into which the central leg portion 1*c* of the E-shaped core 12 is inserted is disposed in an interspace between the primary coil N1 and the secondary coil N22. One surface of the spacer SP1 contacts with the primary coil N1, and the other surface thereof contacts with the secondary coil N21. One surface of the spacer SP2 contacts with the primary coil N1, and the other surface thereof contacts with the secondary coil N22.

By disposing the spacer SP in an interspace in the coil housing space of the core assembly 1, the primary coil N1 and the secondary coil N2 can be positioned easily in the first to third embodiments. As a result, the secondary coil N2 can be distanced from the gap G easily such that the space for reducing leakage flux from the gap G that acts on the secondary coil N2 can be formed easily between the secondary coil N2 and the gap G. Note that, identical configurations to the first to third embodiments have been allocated identical reference symbols, and description thereof has been omitted.

Several preferred embodiments of the present invention were described above, but various amendments and modifications may be applied thereto by a person skilled in the art without departing from the original spirit and scope of the invention, or in other words without departing from the scope of the claims.

The invention claimed is:

1. A transformer comprising:

a core assembly, which is composed of a pair of E-shaped cores each having two side leg portions and a central leg portion between said two side leg portions, and in which end surfaces of said central leg portions and end surfaces of said side leg portions of said E-shaped cores oppose each other, respectively, and a gap is provided between said end surfaces of said central leg portions;

a primary coil which is formed by winding a round Litz wire around a perimeter of said central leg portion; and a secondary coil which is formed by winding a strip-shaped rectangular wire around a perimeter of said central leg portion by edgewise winding and which has a smaller number of windings than a number of windings of the primary coil, whereby the secondary coil outputs a lower voltage than an input voltage to the primary coil and a larger current than an input current to the primary coil, wherein said secondary coil is not radially adjacent to said gap so that a space for reducing leakage flux from said gap that acts on said secondary coil is provided between the secondary coil and the gap.

2. The transformer according to claim 1, wherein said secondary coil is wound only in a region opposing a side face of said central leg portion of either one of said E-shaped cores.

3. The transformer according to claim 1, wherein said secondary coil is wound in a region opposing said gap, and a space is formed between said gap and an inner peripheral surface of said secondary coil.

4. The transformer according to claim 1, wherein said primary coil is wound in a region opposing said gap, and said secondary coil is wound so as to be divided in two regions opposing side faces of the respective central leg portions of said pair of E-shaped cores.

5. The transformer according to claim 1, wherein said primary coil is wound in a region opposing said gap, said secondary coil is wound so as to be divided in two regions which oppose side faces of the respective central leg portions of said pair of E-shaped cores and which are equidistant from said primary coil, and a connection point of said secondary coil, which is divided and wound in the respective regions, is used as a center tap.

6. The transformer according to claim 1, wherein said transformer is provided with a spacer which contacts with at least one of said primary coil and said secondary coil to perform positioning of said primary coil and said secondary coil.

7. The transformer according to claim 2, wherein said transformer is provided with a spacer which contacts with at least one of said primary coil and said secondary coil to perform positioning of said primary coil and said secondary coil.

8. The transformer according to claim 3, wherein said transformer is provided with a spacer which contacts with at least one of said primary coil and said secondary coil to perform positioning of said primary coil and said secondary coil.

9. The transformer according to claim 4, wherein said transformer is provided with a spacer which contacts with at least one of said primary coil and said secondary coil to perform positioning of said primary coil and said secondary coil.

10. The transformer according to claim 5, wherein said transformer is provided with a spacer which contacts with at least one of said primary coil and said secondary coil to perform positioning of said primary coil and said secondary coil.

11. The transformer according to claim 1, wherein said primary coil and said secondary coil are arranged in the same axis with and in different planes from each other.

12. The transformer according to claim 1, wherein said primary coil is arranged adjacent to said gap.

13. The transformer according to claim 1, wherein said primary coil is wound only in a region opposing a side face of said central leg portion of one of said E-shaped cores, said secondary coil is wound only in a region opposing a side face of said central leg portion of the other of said E-shaped cores, and said primary coil and said secondary coil are not radially adjacent said gap.

14. The transformer according to claim 1, wherein said secondary coil is wound in a region opposing said gap, said secondary coil having an inner diameter larger than a diameter of said central leg portion, whereby a space for reducing leakage flux from said gap that acts on said secondary coil is provided between the inner peripheral surface of the secondary coil and the gap.

* * * * *